United States Patent [19]

Ogawa

[11] 4,347,195

[45] Aug. 31, 1982

[54] CARBURETOR

[75] Inventor: Kouhei Ogawa, Saitama, Japan

[73] Assignee: Honda Giken Kogyo Kabushiki Kaisha, Tokyo, Japan

[21] Appl. No.: 248,300

[22] Filed: Mar. 27, 1981

[30] Foreign Application Priority Data

Mar. 31, 1980 [JP] Japan ..... 55-41617

[51] Int. Cl.[3] ..... F02M 13/06

[52] U.S. Cl. ..... 261/18 R; 123/575; 261/50 R; 261/44 C; 261/121 B

[58] Field of Search ..... 261/18 R, 71, 67, 121 B, 261/44 C, 50 R; 123/575, 576, 577, 578

[56] References Cited

U.S. PATENT DOCUMENTS

| | | | |
|---|---|---|---|
| 1,616,726 | 2/1927 | Wilcox | 261/121 B |
| 1,729,382 | 9/1929 | Harel | 261/121 B |
| 2,039,990 | 5/1936 | Gustafsson | 261/18 R |
| 2,633,341 | 3/1953 | Reistad | 261/71 |
| 3,689,036 | 9/1972 | Kikuchi et al. | 261/44 C |
| 4,052,490 | 10/1977 | Fedison | 261/71 |
| 4,097,563 | 6/1978 | Yuzawa | 261/121 B |
| 4,129,620 | 12/1978 | Etoh | 261/18 R |
| 4,132,199 | 1/1979 | Kuroiwa et al. | 261/67 |
| 4,178,332 | 12/1979 | Hogeman et al. | 261/121 B |

FOREIGN PATENT DOCUMENTS

| | | | |
|---|---|---|---|
| 743348 | 5/1932 | France | 261/121 B |
| 46-12854 | 2/1971 | Japan | 261/18 R |
| 151152 | 9/1920 | United Kingdom | 261/18 R |
| 177197 | 3/1922 | United Kingdom | 261/71 |
| 230043 | 3/1926 | United Kingdom | 261/71 |
| 703113 | 1/1954 | United Kingdom | 261/18 R |

*Primary Examiner*—Tim R. Miles

*Attorney, Agent, or Firm*—Armstrong, Nikaido, Marmelstein & Kubovcik

[57] ABSTRACT

A carburetor in which a main-fuel flow rate characteristic and a slow-fuel flow rate characteristic are changeable in accordance with the change of kind of fuel such as between gasoline and alcoholic fuel or the change in the engine operating condition such as atmospheric pressure. The carburetor has a main nozzle opening to an intake passage, a main fuel passage connecting the main nozzle with a float chamber, a slow fuel nozzle opening to the intake passage, a slow fuel passage connecting the slow fuel nozzle with the main fuel passage, and a change-over valve interposed between the main fuel passage and the slow fuel passage. The change-over valve is provided with a plurality of main jet ports of different diameters and a plurality of slow jet ports of different diameters for changing the degree of communications between the main fuel passage and the float chamber, and between the slow fuel passage and the main fuel passage.

4 Claims, 4 Drawing Figures

CARBURETOR

BACKGROUND OF THE INVENTION

1. Field of the Invention

The present invention relates to an improvement in a carburetor having a main fuel passage communicating with a main nozzle and a slow fuel passage leading to slow fuel ports such as idle port.

2. Description of the Prior Art

Due to the shortage of crude oil, there have been made various approaches to alcoholic fuel which is comparatively easy to produce, as a fuel substituting for the gasoline. The alcohol, however, has a calorific power which is about a half of that of the gasoline. Therefore, for obtaining the engine output equivalent to that produced by gasoline, it is necessary to use the alcoholic fuel at a rate which is about twice as large as that of the gasoline. Therefore, if the engine is required to operate with a carburetor of the type mentioned above, the carburetor has to have a main fuel flow rate characteristic and a slow-fuel flow rate characteristic optimized for the use of the alcoholic fuel.

At the present stage, however, the alcoholic fuel is not spread commercially so widely, and only gasoline is available in most of the gas stations. From this point of view, it is highly desirable that the aforementioned characteristics of the carburetor can be switched as desired between the mode for operation with gasoline and the mode for operation with alcoholic fuel. The switching of the characteristics of the carburetor is required also when the condition of engine operation is changed due to change of atmospheric pressure and so forth, even when the same fuel is used continuously.

SUMMARY OF THE INVENTION

It is, therefore, a major object of the invention to provide a carburetor capable of fulfilling the above described demands.

To this end, according to the invention, there is provided a carburetor comprising: an intake passage, a main nozzle opening to the intake passage, a float chamber, a main fuel passage for connecting the main nozzle with the float chamber, a slow fuel port opening to the intake passage, a slow fuel passage for connecting the slow fuel nozzle with the main fuel passage, and a change-over valve interposed between the main fuel passage and the slow fuel passage, the change-over valve being provided with main jet ports of different diameters and slow jet ports of different diameters adapted to change the degree of communications between the main fuel passage and the float chamber and between the slow fuel passage and the main fuel passage.

The above and other objects, features and advantages of the present invention will be better understood from the ensuing detailed description of the invention when read in conjunction with the accompanying drawings which illustrate a presently preferred embodiment of the invention.

BRIEF DESCRIPTION OF THE DRAWINGS

The accompanying drawings show a preferred embodiment of the invention in which.

DESCRIPTION OF THE PREFERRED EMBODIMENT

Figure 1:
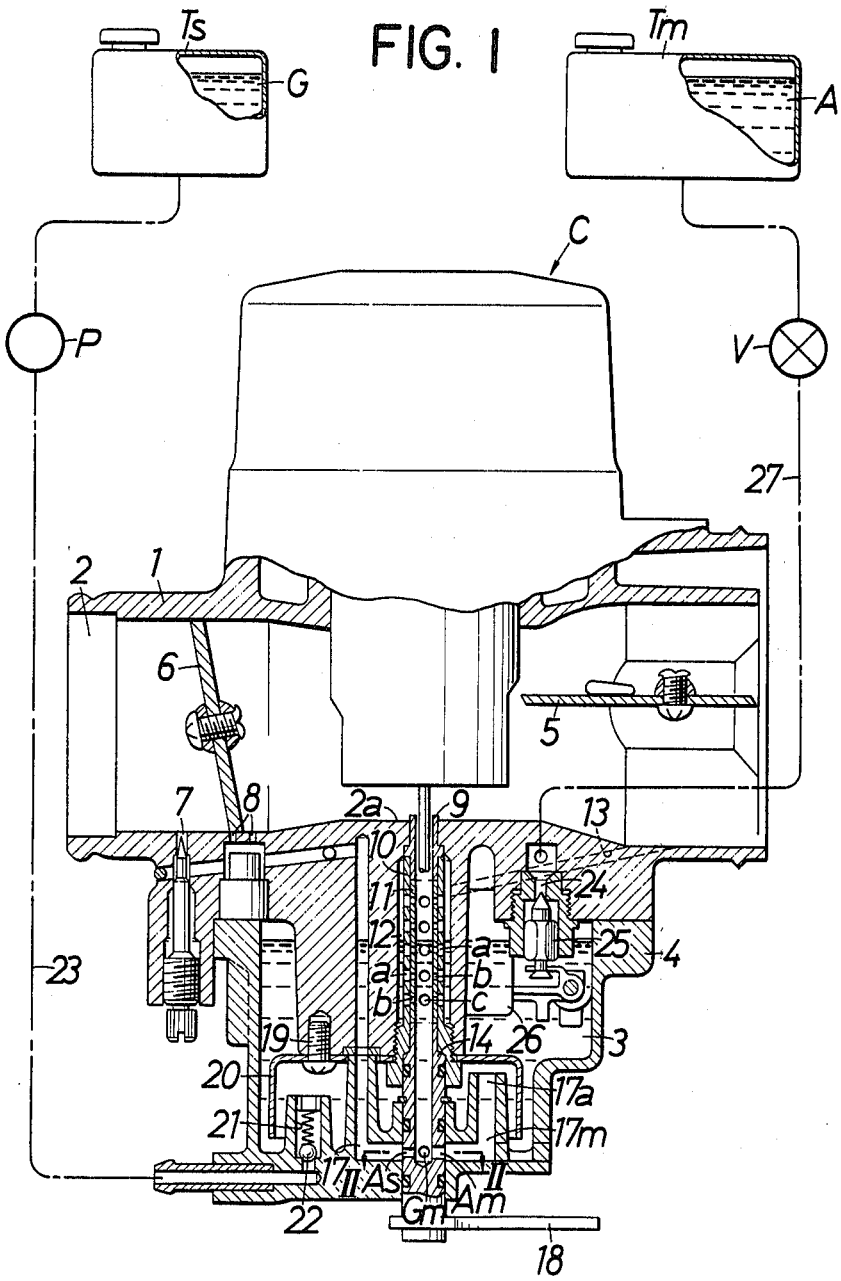
FIG. 1 is a side elevational view of the whole part of a carburetor constructed in accordance with the invention, with an essential part thereof sectionally shown.

A preferred embodiment of the invention will be described hereinunder with reference to the accompanying drawings. The described embodiment is a carburetor C which can be switched between a mode for operation with gasoline and a mode for operation with an alcoholic fuel.

Referring to the drawings, the carburetor C of the invention has a body 1 provided with a horizontal intake passage 2. A vessel 4 defining a float chamber 3 is coupled to the lower side of the body 1 of the carburetor. The intake passage 2 is provided at its mid portion with a venturi 2*a*. A choke valve 5 is disposed in the upstream side (right side in the drawings) of the venturi portion 2*a*, while a throttle valve 6 is disposed at the downstream side (left side in the drawings) of the same. An idle port 7 opens to the intake passage at a portion slightly downstream of the throttle valve 6, while a by-pass port 8 and a main nozzle 9 open to the intake passage at portions near the throttle valve 6 and the venturi portion 2*a*, respectively.

The main nozzle 9 is supported by the upper end of a supporting sleeve 10 screwed to the lower end of the carburetor body 1. An air bleed pipe 11 communicating with the main nozzle 9 is rotatably fitted in the supporting sleeve 10.

The supporting sleeve 10 has two rows of apertures a,a..; a,a.. diametrically opposing to each other, each row of which is vertically formed in the peripheral wall of the sleeve. The air bleed pipe 11 has four vertical rows of air bleed ports b,b..; b,b..; c,c..; c,c.. in the peripheral wall thereof, which are arranged at a 90° interval in the circumferential direction. The arrangement is such that, by a reciprocatory 90° rotation of the air bleed pipe 11 through the operation of a later-mentioned change-over valve 14, the groups of air bleed ports b,b..; b,b.. and the groups of air bleed ports c,c..; c,c.. are alternatingly brought into communication with the group of apertures a,a..; a,a.. of the air bleed pipe 11. The groups of air bleed ports b,b..; b,b.. are sized to provide an air bleeding effect optimum for the engine operation with the alcoholic fuel, while the groups of air bleed ports c,c..; c,c.. are sized to provide an air bleeding effect optimum for the engine operation with gasoline. The apertures a are formed to have a diameter greater than those of the air bleed ports b and c.

An annular chamber 12 for communication with each aperture a is formed in the outer peripheral surface of the supporting sleeve 10. This chamber 12 is communicated with the portion of the intake passage 2 upstream from the venturi portion 2*a* through an air passage 13.

A change-over valve 14 having a bottom-equipped cylindrical body extending through the bottom wall of the vessel 4 is rotatably fitted at its upper end in the supporting sleeve 10. The interior of the change-over valve 14 is communicated with the interior of the air bleed pipe 11. The change-over valve 14 and the air bleed pipe 11 are operatively coupled to each other by a mutual engagement between a recess 15 and a projection 16 formed in their opposing ends, so that these two members may be rotated as a unit with each other. The change-over valve 14 has four jet ports arranged at a 90° interval on its circumference. These four jet ports are: a main jet port Am for alcoholic fuel, a slow jet port As for alcoholic fuel, a main jet port Gm for gasoline and a slow jet port Gs for gasoline.

The arrangement is such that, as the change-over valve 14 is rotated 90° reciprocatingly, a fuel passage 17 extending through the bottom wall of the vessel 4 is brought into communication selectively with the group of jet ports Am,As and the group of jet ports Gm,Gs. The lower end of the change-over valve 14 is projected to the outside of the vessel 4 and is closed. A change-over lever 18 is fixed to this lower end of the change-over valve 14.

In the float chamber 3, a cup-shaped member 20 is attached to the lower surface of the body 1 of the carburetor with its opening directed downwardly, by means of the supporting sleeve 10 and a screw 19. An inlet 17*a* of the aforementioned fuel passage 17 is formed at an upper portion of the cup-shaped member 20. The portion of the fuel passage 17 between the inlet 17*a* and the change-over valve 14 forms, in cooperation with the fuel passages in the change-over valve 14 and the air bleed pipe 11, a main fuel passage 17*m*, while the remained portion of the fuel passage 17 extends to the by-pass port 8 and the idle port 7 to form a slow fuel passage 17*s*.

An auxiliary fuel supply port 21 is formed in the bottom wall of the vessel 4 to open into the cup-shaped member 20. A fuel passage 23 leading from an auxiliary fuel tank Ts is connected to the auxiliary fuel supply port 21. A metering pump P disposed at an intermediate portion of the fuel passage 23 has a delivery valve 22 which is placed in the auxiliary fuel supply port 21. The auxiliary fuel tank Ts stores gasoline G as the starting fuel.

A main fuel supply port 24 opens in the upper surface of the float chamber 3. A float valve 25 which is known per se is disposed in this opening of the main fuel supply port 24 to open and close the latter by the action of a float 26 in the float chamber 3 so as to maintain a constant level of the fuel in the float chamber 3. A fuel passage 27 leading from a main fuel tank Tm is connected to the main fuel supply port 24. A fuel cock V which is known per se is disposed at an intermediate portion of the fuel passage 27. The main fuel tank Tm stores an alcoholic fuel A as the main fuel.

The carburetor of this embodiment, having the construction heretofore described, operates in a manner explained hereinunder.

Figure 2:
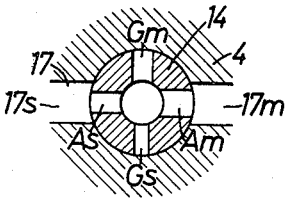
FIG. 2 is an enlarged sectional view taken along line II—II of FIG. 1.

When the alcoholic fuel A is stored in the main fuel tank Tm as illustrated in FIG. 1, the change-over lever 18 is set at the position for engine operation with alcoholic fuel, so that the alcoholic main jet port Am and the alcoholic slow jet port As are brought into communication with the main fuel passage 17*m* and the slow fuel passage 17*s*, respectively, as shown in FIG. 2. Meanwhile, the groups of air bleed ports for alcoholic fuel b,b..; b,b.. are made to open to the groups of apertures a,a..; a,a..

For starting the engine when the ambient temperature is low, the cock V is opened to fill the float chamber 3 up to a predetermined level with the alcoholic fuel A coming from the main fuel tank Tm through the passage 27. Then, the metering pump P is actuated to inject a predetermined amount of gasoline G from the auxiliary fuel tank Ts through the fuel passage 23 into the cup-shaped member 20. As a result, the alcoholic fuel A which has occupied the space in the cup-shaped member 20 is pushed out from the lower side of the cup-shaped member 20 due to the injection pressure of the gasoline G and due to the difference of specific weight between both fuels A,G, to be replaced by the gasoline G. In consequence, the space in the cup-shaped member 20 is filled by the gasoline G and the level of the fuel in the float chamber 3 is raised.

In this state, the choke valve 5 is closed while the throttle valve 6 is opened to a suitable fast idle opening. As the engine is cranked, the intake vacuum generated by the engine is strongly applied to the idle port 7 and the by-pass port 8, so that the gasoline G in the cup-shaped member 20 is forced to flow through the passage 17*m*, jet ports Am,As and passage 17*s* to be jetted from the ports 7,8. The gasoline thus jetted is mixed with air to form an air-fuel mixture in the intake passage 2. This mixture is directly sucked by the engine to start the latter.

Soon after the starting of the engine, the throttle valve 6 is opened to load the engine so that the intake vacuum of the engine is applied to the main nozzle 9 in accordance with the increase of the opening degree of the throttle valve 6. In consequence, the gasoline G residing in the cup-shaped member 20 is forcibly moved through the main fuel passage 17*m*, main jet port Am and air bleed pipe 11, so as to be supplied through the main nozzle 9 to the engine, so that the engine operation is shifted to the loaded operation in quite a smooth manner even immediately after the starting of the engine. As the gasoline G in the cup-shaped member 20 is consumed, the alcoholic fuel A in the float chamber 3 gradually comes into the cup-shaped member 20 from the lower side of the latter. Finally, the space in the cup-shaped member 20 is wholly occupied by the alcoholic fuel so that the engine operates with the alcoholic fuel A as the main fuel.

The amount of the alcoholic fuel A supplied to the idle port 7 and by-pass port 8, and the amount of the same supplied to the main nozzle 9 are properly measured by the alcoholic fuel slow jet port As and by the alcoholic fuel main jet port Am, respectively.

The air introduced from the upstream portion of the intake passage 2 into the air passage 13 flows through the annular chamber 12 and jets into the air bleed pipe 11 through the multiplicity of air bleed ports b,b... for alcoholic fuel. In consequence, the air is blown in the form of air bubbles into the alcoholic fuel A flowing up toward the main nozzle 9 through the air bleed pipe 11 by an amount optimum for atomization of the fuel A. Thus, the engine operation as expected can be obtained.

Figure 3:
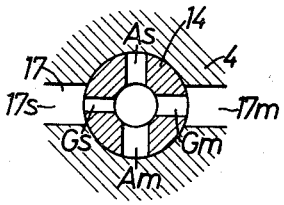
FIG. 3 is a sectional view similar to that of FIG. 2 with a rotary cylinder rotated to a position different from that shown in FIG. 2.
Figure 4:
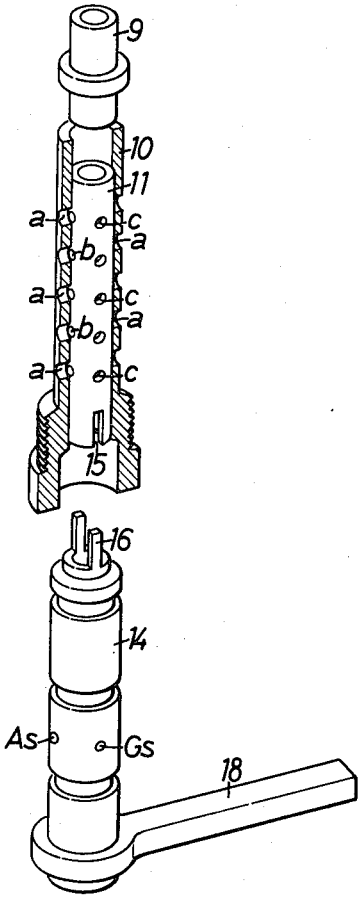
FIG. 4 is a vertical sectional perspective view showing a main nozzle, air bleed pipe, supporting sleeve and change-over valve.

In the event that the alcoholic fuel is not available in the gas station to enforce the driver to drive his automobile by the gasoline, the gasoline is poured into the main fuel tank Tm and the change-over lever 18 is rotated 90° from the position shown in the drawings to take the position for the engine operation with gasoline. In consequence, the change-over valve 14 and the air bleed pipe 11 are rotated to take the position shown in FIG. 3 where the gasoline main jet port Gm and the gasoline slow jet port Gs open to the main fuel passage 17*m* and the slow fuel passage 17*s*, respectively. Meanwhile, the air bleed ports c,c..; c,c.. are made to open to the apertures a,a..; a,a.. In consequence, as the engine is started, the amount of the gasoline supplied to the ports 7,8 is adjusted by the gasoline slow jet port Gs to about a half of that of the alcoholic fuel, while the amount of the gasoline supplied to the main nozzle 9 is adjusted by the gasoline main jet port Gm also to about a half of that of the alcoholic fuel. At the same time, air bubbles are relieved into the gasoline flowing through the air bleed pipe 11, at a rate suitable for the atomization of the fuel, through the air bleed ports c,c... Thus, the engine operates safely with the gasoline as the main fuel.

In the case where it is required to change the flow rate characteristic of each of fuel and air in accordance with variable engine operating condition such as a change in the atmospheric pressure, while using the same fuel, the jet ports Am,As and the air bleed port b can be shaped and sized to provide flow rate characteristics optimum for the engine operation at the sea level, while the jet ports Gm,Gs and the air bleed port C can be shaped and sized to meet the engine operation at a large altitude.

As has been described, according to the invention, there is provided a carburetor having a change-over valve 14 through which the main fuel passage 17*m* is communicated with the float chamber 3 and the slow fuel passage 17*s* is communicated with the main fuel passage 17*m*. The change-over valve 14 is provided with main jet ports Am,Gm of different diameters and slow jet ports As,Gs of different diameters for changing the degree of communication between the main fuel passage 17*m* and the float chamber 3 and the degree of communication between the slow fuel passage 17*s* and the main fuel passage 17*m*. It is, therefore, possible to simultaneously change the flow rate characteristics of the main fuel and slow fuel simply by a single switching operation of the change-over valve 14 so as to enable the enging to operate on different kinds of fuel or under different operating conditions such as a change in atmospheric pressure thereby to obtain the required performance of the engine. In addition, the transition in engine operation from the low-speed operation to the high-speed operation is effected in quite a smooth manner while achieving a fuel economy, because the main fuel and the slow fuel are supplied through a common change-over valve 14.

In further accordance with the invention, the air bleed pipe 11 having the main fuel passage 17*m* defined therein is rotatably fitted in a stationary supporting sleeve 10 having a plurality of apertures a,a.. in its peripheral wall. The sleeve 10 is surrounded by an annular chamber 12 communicating with the intake passage 2 upstream of the main nozzle. In the peripheral wall of the air bleed pipe 11 formed are a plurality of groups of air bleed ports b,b..; c,c.. having different air bleeding characteristics and adapted to be selectively communicated with the apertures a,a.. in the supporting sleeve 10 in accordance with the rotation of the air bleed pipe 11. The air bleed pipe 11 is operatively connected to the change-over valve 14. Therefore, it is possible to simultaneously change both the fuel flow rate characteristic and the air flow rate characteristic simply by a single switching operation of the change-over valve 14.

What is claimed is:

1. A carburetor comprising an intake passage, a main nozzle opening to the intake passage, a float chamber, a main fuel passage for connecting said main nozzle with said float chamber, a slow fuel nozzle opening to said intake passage, a slow fuel passage for connecting said slow fuel nozzle with said main fuel passage, a change-over valve interposed between said main fuel passage and said slow fuel passage, said change-over valve being provided with main jet ports of different diameters and slow jet ports of different diameters for changing the degree of communications between said main fuel passage and said float chamber and between said slow fuel passage and said main fuel passage, a stationary supporting sleeve having groups of apertures formed in the peripheral wall thereof and an annular chamber surrounding said peripheral wall, said annular chamber communicating with said intake passage upstream of said main nozzle, and an air bleed pipe rotatably fitted in said supporting sleeve and having said main fuel passage defined therein, said air bleed pipe being provided in its peripheral wall with a plurality of groups of air bleed ports of different air bleed characteristics, said air bleed ports being adapted to be placed in selective communication with said groups of apertures of said supporting sleeve in accordance with the rotational position of said air bleed pipe.

2. A carburetor as claimed in claim 1, wherein said change-over valve has a bottomed hollow cylindrical body having a peripheral wall in which said main jet ports and said slow jet ports are formed, the hollow interior of said cylindrical body being in communication with the interior of said air bleed pipe.

3. A carburetor as claimed in claim 2, wherein said change-over valve is operatively connected to said air bleed pipe.

4. A carburetor as claimed in any one of claims 1, 2 or 3, wherein said change-over valve is operated from the outside.

* * * * *